US006193861B1

(12) United States Patent
Uzoh

(10) Patent No.: US 6,193,861 B1
(45) Date of Patent: Feb. 27, 2001

(54) APPARATUS AND METHOD TO ENHANCE HOLE FILL IN SUB-MICRON PLATING

(75) Inventor: Cyprian E. Uzoh, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/255,998

(22) Filed: Feb. 23, 1999

(51) Int. Cl.[7] ..... C25D 3/16
(52) U.S. Cl. ..... 204/275.1; 204/279
(58) Field of Search ..... 204/279, 275.1

(56) References Cited

U.S. PATENT DOCUMENTS

| | | | | |
|---|---|---|---|---|
| 4,174,261 | | 11/1979 | Pellegrino | 204/273 |
| 4,443,304 | | 4/1984 | Eidschun | 205/146 |
| 4,692,222 | | 9/1987 | Pellegrino et al. | 205/125 |
| 5,063,951 | | 11/1991 | Bard et al. | 134/64 R |
| 5,435,885 | | 7/1995 | Jones et al. | 216/92 |
| 5,462,649 | * | 10/1995 | Keeney et al. | 205/93 |
| 5,536,388 | | 7/1996 | Dinan et al. | 205/670 |
| 5,543,032 | | 8/1996 | Datta et al. | 205/670 |
| 5,683,564 | * | 11/1997 | Reynolds | 205/68 |
| 5,755,859 | | 5/1998 | Brusic et al. | 106/1.22 |
| 5,793,272 | | 8/1998 | Burghartz et al. | 336/200 |
| 5,807,165 | | 9/1998 | Uzoh et al. | 451/41 |
| 5,830,334 | * | 11/1998 | Kobyashi | 204/224 R |
| 5,904,827 | * | 5/1999 | Reynolds | 205/68 |
| 5,932,077 | * | 9/1999 | Reynolds | 204/224 R |

* cited by examiner

*Primary Examiner*—Kathryn Gorgos
*Assistant Examiner*—Erica Smith Hicks
(74) *Attorney, Agent, or Firm*—Polock, Vande Sande & Amernick; Joseph P. Abate

(57) ABSTRACT

An apparatus for enhancing filling of structures in a substrate. At least one electrolyte evacuator adjacent a surface of a substrate including the structures evacuates electrolyte from the structures. At least one electrolyte injector adjacent the surface of the substrate including the structures injects electrolyte into the structures.

35 Claims, 4 Drawing Sheets

APPARATUS AND METHOD TO ENHANCE HOLE FILL IN SUB-MICRON PLATING

FIELD OF THE INVENTION

The invention relates to semiconductor device, flat panel and packaging manufacture. In particular, the present invention relates to an apparatus and method for enhancing filling of very small structures during plating processes.

BACKGROUND OF THE INVENTION

In the production of microelectronic devices, metal may be plated on a semiconductor for a variety of purposes. The metal may be deposited to form vias or conductive lines, such as wiring structures. Typically, metal is plated on the substrates and cells of reservoirs that hold a plating solution that includes at least one metal and/or alloy to be plated on the substrate.

Plating baths are commonly used in microelectronic device manufacture to plate at least one material, such as a metal on a substrate for a wide variety of applications. For example, plating baths may by utilized for electroplating and/or electroless plating on substrates of one or metals and/or alloys.

SUMMARY OF THE INVENTION

The present invention provides an apparatus for enhancing filling of structures on a substrate, including damascene and non-damascene structures. The apparatus includes at least one electrolyte evacuator adjacent a surface of the substrate including the structures for evacuating electrolyte from the structures. The apparatus also includes at least one electrolyte injector adjacent the surface of the substrate including the structures for injecting electrolyte into the structures.

Additionally, the present invention provides a method of enhancing filling of structures on a substrate, including damascene and non-damascene structures. The method includes exposing the surface of a substrate that includes structures to an electrolyte solution. The electrolyte solution is evacuated from the structures by arranging adjacent the surface of the substrate at least one electrolyte evacuator. The electrolyte solution is injected into the structures by arranging adjacent the surface of the substrate at least one electrolyte injector.

Still other objects and advantages of the present invention will become readily apparent by those skilled in the art from the following detailed description, wherein it is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the drawings and description are to be regarded as illustrative in nature and not as restrictive.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF THE INVENTION

In most conventional electroplating, a workpiece is often cleaned prior to plating. Along these lines, a pre-etch may be performed on the workpiece prior to plating. In some instances, the cleaning or pre-etching can actually harm structures useful in the plating.

In the plating of BEOL thin metals, a seed layer is usually very thin, on the order of about 20 nm to about 80 nm, in field areas. Outside of the field areas, such as inside vias and trenches, the seed layer may be even thinner, such as about one-tenth of the field area thickness. The seed layers often have a thickness of about 3 nm to about 8 nm on the sidewalls. As a result of the thinness of the seed layer, a robust pre-clean or pre-etch conventionally practiced on workpieces having thicker seed layers, on the order of about 150 nm or greater, is not desirable. This is because the pre-clean or pre-etch may etch away the very fine seed layer on the walls of the vias and trenches, such as in corner regions where a sidewall abuts a bottom of a via, where seedlayers tend to be thinnest or non-existent.

In addition to the problem of etching thin seed layers in BEOL structures, electroplating of workpieces with sub-micron dimensions often produces particular problems when the workpiece is facing down, as it does in most cup platers. For plating to be effective, air bubbles should not be present on surfaces to be plated. Along these lines, air bubbles must escape from the trenches, vias and any other structures prior to the onset of plating. The existence of air bubbles may prevent plating in some places. Also, air bubbles may be incorporated in the plated metal. Air bubbles may make the plating less effective in areas of the substrate where bubbles are present than in others where no air bubbles exist. High quality plating is very important in all electronic device structures, and even more so in structures with sub-micron dimensions.

Figure 6A:
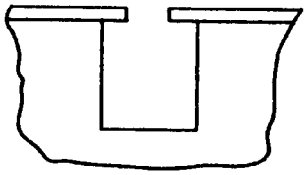
FIGS. 6*a*, 6*b*, and 6*c* represent examples of structures that include undercut features.
Figure 6B:
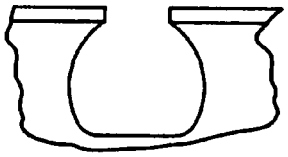
Figure 6C:
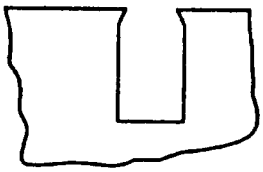

While air bubble removal may be aided by the presence of surfactants in the electrolytes, a soaking or dwell time is also required to permit the electrolyte to wet and also displace air in the features. This introduces a conflicting requirement with respect to reducing the time that the structure is exposed to an in situ pre-clean or pre-etch process. Along these lines, while it may be desired to limit exposure of thin seed layers to the pre-clean or pre-etch, there is a competing desire to permit the structure to sit for a longer time for air bubbles to escape from blind trenches and vias. Trapped air bubbles and/or loss of the seed layer present two big problems encountered in plating operations, particularly on very thin seed layers. The difficulty with air bubbles may be increased when structures include re-entrant openings as may occur in structures with undercut features, such as those illustrated in FIGS. 6*a*, 6*b*, and 6*c*.

As stated above, ensuring contact of plating solutions with surface of workpieces being plated is important to help ensure that plating occurs and that high quality plating occurs uniformly on the workpiece. The present invention helps to address the competing interests discussed above between the long dwell times for bubbles to escape from small openings in the workpiece and the very short dwell times desired to minimize seed layer losses. The present invention accomplishes this resolution through one or more of a variety of actions.

For example, the present invention may mechanically thin a boundary layer of electrolyte adjacent a substrate that may include sub-micron features, as found on damascene or non-damascene structures for example. The present invention may additionally or alternatively evacuate electrolyte from the sub-micron structures and/or inject electrolyte into the sub-micron structures. Furthermore, the present invention may also or alternatively enhance the removal of air bubbles in sub-micron structures through its action to thin the boundary layer and/or evacuate and/or inject electrolyte into the sub-micron structures.

Typically, sub-micron structures can include trenches, vias, and/or other structures or surfaces to be plated. By enhancing mass transfer, the present invention thereby improves primary, secondary, and tertiary current distribution in structures of sub-micron dimensions.

Figure 1:
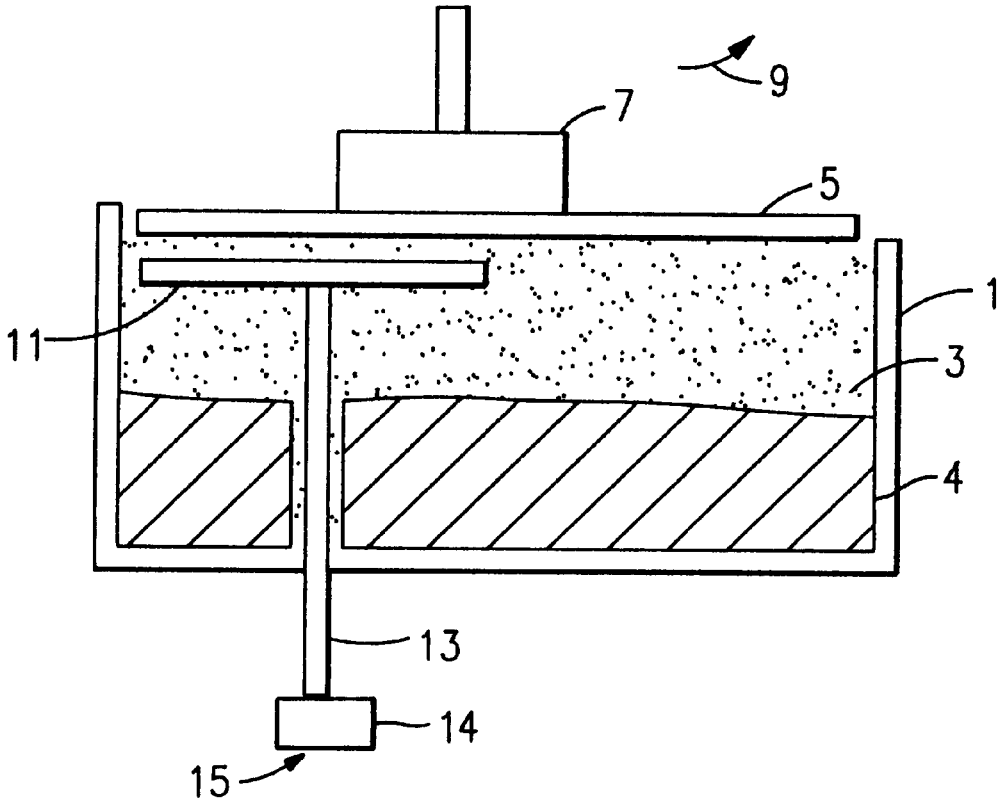
FIG. 1 represents a cross-sectional view of an embodiment of a plating apparatus that includes an embodiment of an apparatus for enhancing filling of sub-micron damascene and non-damascene structures according to the present invention.

FIG. 1 illustrates an example of an embodiment of a plating apparatus that includes an embodiment of a plating enhancer according to the present invention. The plating apparatus illustrated in FIG. 1 includes a plating tank 1. The plating tank is filled with plating solution 3. An anode 4 is arranged in the plating tank. A substrate with seedlayer to be plated 5 is retained by a substrate support 7. Substrate support 7 may rotate as indicated by arrow 9 to help facilitate operation of the present invention and/or to facilitate the plating operation.

FIG. 1 also illustrates an embodiment of a device according to the present invention. The embodiment illustrated in FIG. 1 includes at least one shaped blade 11 for helping to evacuate electrolyte, inject electrolyte and/or mechanically thin electrolyte in the region adjacent the substrate 5. The blade 11 may be supported by support 13.

As indicated by arrow 15, the blade 11 may rotate. Rotation of blade 11 may range from about 10 to about 200 revolutions per minute. Rotation of the blade may further enhance operation of an apparatus according to the present invention. However, it is not necessary that the blade or other evacuator, injector, or mechanical thinner rotate, move laterally or otherwise move. Movement of the blade or other device may be in addition to or alternative to movement of the substrate, such as rotation of the substrate represented by arrow 9.

As stated above, the filling of sub-micron structures may be especially be difficult in arrangements such as that illustrated in FIG. 1 where the surface of the substrate 5 including the sub-micron structures faces down.

Figure 2:
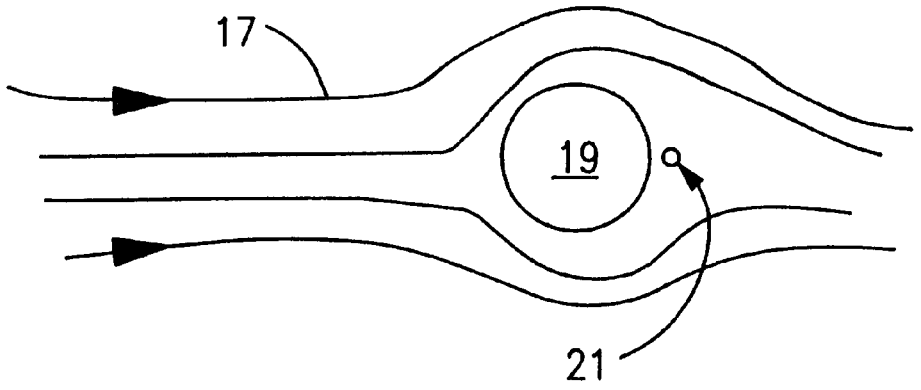
FIG. 2 illustrates fluid flow about an object illustrating a stagnation zone.

FIG. 2 represents a diagram illustrating fluid flow as indicated by lines 17 around an object 19. As can be seen in FIG. 2, a stagnation zone 21 may develop in the vicinity of the trailing edge of the object 19 in relationship to the fluid flow. The stagnation zone is caused by flow separation around the object 19.

To address the problem of an efficient plating of sub-micron structures, the present invention may include an apparatus that includes at least one electrolyte passive and/or non-passive evacuator adjacent a surface of a substrate including the sub-micron structures for enhancing electrolyte flow to and from the sub-micron structures. The present invention may also include at least one electrolyte passive and/or non-passive injector adjacent the surface of the substrate including the sub-micron structures for enhancing the injection of electrolyte into the sub-micron structures. The present invention may also include at least electrolyte boundary layer mechanical thinner adjacent the surface of the substrate including sub-micron structures for mechanically thinning the boundary layer of the electrolyte adjacent the substrate. The same structure may perform all of these functions. On the other hand, individual structures may be included in an apparatus according to the present invention for including for performing one or more of these functions.

According to one embodiment of the present invention, the apparatus includes at least one electrolyte passive and non-passive evacuator and at least one electrolyte passive and non-passive injector. Each of the electrolyte evacuator and electrolyte injector includes a blade. The blades of the electrolyte evacuator and electrolyte injector may have different contours and/or cross-sections as well as a different angle of pitch, and/or arrangement with respect to the substrate being plated. The blades may function as an electrolyte evacuator or an electrolyte injector. In performing these functions, the blades may also each function as an electrolyte boundary layer mechanical thinner.

Typically, an electrolyte evacuator, electrolyte injector or electrolyte boundary layer mechanical thinner according to the present invention does not touch the substrate to be plated. Rather, the structures typically are arranged in close proximity to the substrate being plated. According to one example, the present invention includes an electrolyte evacuator and electrolyte injector that each include a blade, such that the blades are is arranged less than 150 $\mu$m from the surface of the substrate.

Figure 3A:
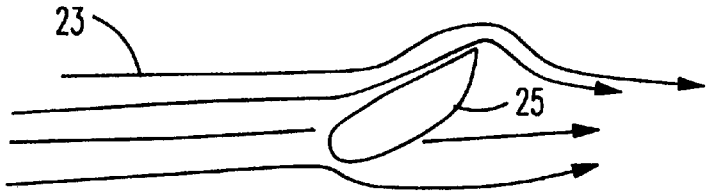
FIG. 3*a* illustrates fluid flow about an embodiment of an electrolyte injector, an electrolyte evacuator, and/or a boundary layer mechanical thinner according to the present invention.

FIG. 3*a* illustrates a cross-sectional view of fluid flow, indicated by lines 23, around a pitched blade 25 as the fluid moves around the blade or the blade moves through the fluid. Also, the pitched blade may rock or have its position altered in other ways, varying the position of the blade, such as by varying the pitch angle, relative to the substrate.

Figure 3B:
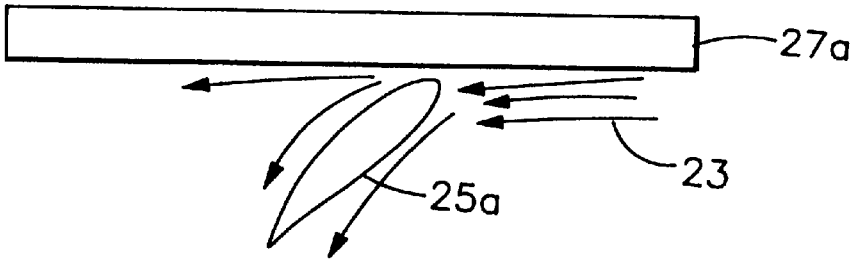
FIG. 3*b* illustrates fluid flow about another embodiment of an electrolyte injector, an electrolyte evacuator, and/or a boundary layer mechanical thinner according to the present invention arranged adjacent a substrate to be plated.
Figure 3C:
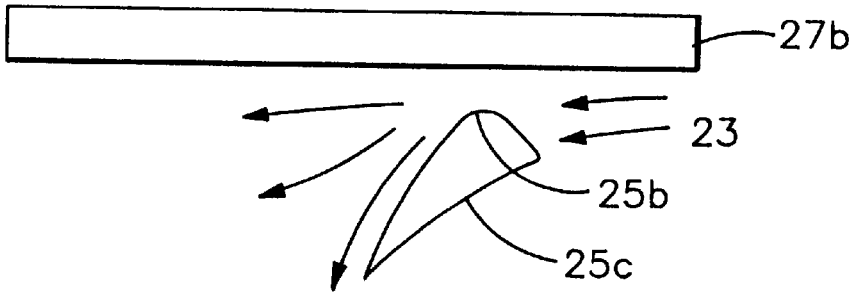
FIG. 3*c* illustrates fluid flow about a further embodiment of an electrolyte injector, an electrolyte evacuator, and/or a boundary layer mechanical thinner according to the present invention arranged adjacent a substrate to be plated.

The exact configuration of a blade according to the present invention may vary, depending upon the application. For example, FIG. 3*b* illustrates a cross-sectional view of an embodiment air-foil shaped blade 25*a* pitched relative to a substrate 27*a*. On the other hand, FIG. 3*c* illustrates an embodiment of a blade 25*c* according to the present invention with a combination shape. In both FIGS. 3*b* and 3*c*, flow of solution about the blades is indicated by arrows 23.

The embodiment illustrated in FIG. 3*c* includes a portion 25*b* having a planar surface. Planar portion 25*b* may enhance the shearing action of the fluid on the substrate 27*b*. Planar portion 25*b* may also help to pull plating solution from the structures in the substrate. The planar portion 25*b* typically is arranged such that it is parallel to the surface of the substrate to be plated. The length of the planar portion 25*b* may vary, depending upon the desired effect. For example, the planar portion may have a length of about 2 mm to about 4 mm.

Figure 4:
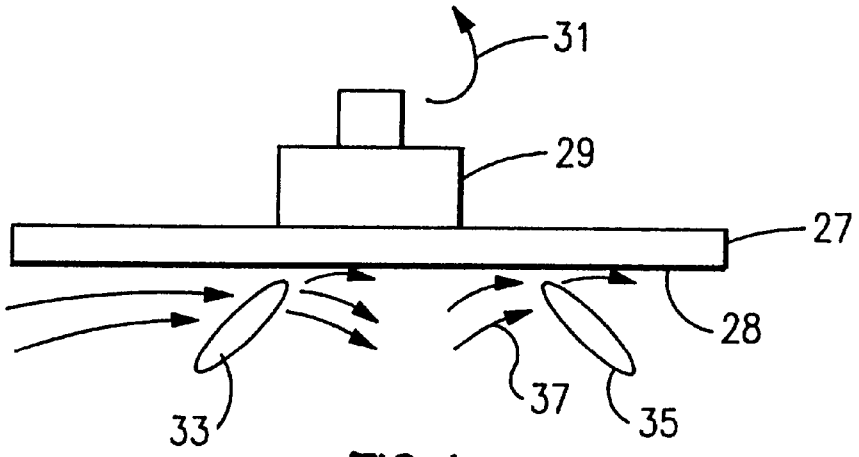
FIG. 4 represents a cross-sectional view of an embodiment of an apparatus according to the present invention illustrating embodiments of an electrolyte injector and an electrolyte evacuator according to the present invention.

FIG. 4 illustrates an embodiment of the present invention that includes an electrolyte injector and electrolyte boundary layer mechanical thinner that includes two blades, the contour or inclination of the blades may be different as indicated in FIG. 4. FIG. 4 illustrates a semiconductor wafer 27 supported by support 29. As indicated by arrow 31, the support 29 and the wafer 27 may rotate by means of a shaft 13. Blades 33 and 35 may be arranged adjacent surface 28 of the wafer 27. As can be seen in FIG. 4, blade 33 may act as a fluid evacuator as the substrate passes adjacent the blade. On the other hand, a build up of fluid as indicated by arrows 37 adjacent blade 35 may cause blade 35 to act as a fluid injector. While a combination shaped blade 25*c* of FIG. 3*c*, with a flat zone 25*b* can enhance fluid exchange and shearing action of fluid on substrate 27.

As can be seen in FIG. 4, the blades may be arranged such that they each include a leading edge and a trailing edge. As the blades and/or the workpiece moves, typically as the substrate rotates as indicated by arrow 31, a leading blade may enhance evacuate fluid in the trenches and vias and other sub-microns structures, such as blade 33 or 25*c*. Simultaneously, the trailing blade, such as blade 35 or trailing edge of the blade 35 or 25*c*, injects or forces electrolyte into the sub-micron structures.

Evacuating electrolyte may also result in evacuating bubbles from the sub-micron structures. Forcing or injecting electrolyte into the sub-micron structures may also help to evacuate air bubbles from the structures. Both the evacuation and the injection of electrolyte (enhanced mass transfer) from and into the sub-micron structures can enhance plating and, as a result, electromigration life of chip interconnections.

As stated above, the electrolyte injector, electrolyte evacuator, and/or boundary layer mechanical thinner may be altered in position at any point prior to or during filling of the sub-micron structures. The position altering means for one or more of these structures may include at least one motor 14 for rotating and/or laterally altering the position of one or more of the structures individually or together.

In other words, the position of any one or more of the structures may be moved independently or together prior to, during, or after the plating. Along these lines, the position of the elements may be altered at the same or different rates.

The present invention may also include a plating cup.

As described above, the present invention also includes a method of enhancing the filling of sub-micron structures. The method includes exposing the surface of the substrate that includes the sub-micron structures to an electrolyte solution. Electrolyte may be evacuated from the sub-micron structures in the substrate by arranging adjacent the surface of the substrate including the sub-micron structures at least one electrolyte evacuator. Electrolyte may also be injected into the sub-micron structures by arranging adjacent the surface of the substrate including the sub micron structures at least one evacuator. Additionally and/or alternatively, a boundary layer of the electrolyte adjacent the surface of the substrate including the sub-micron structures may be mechanically thinned.

Figure 5:
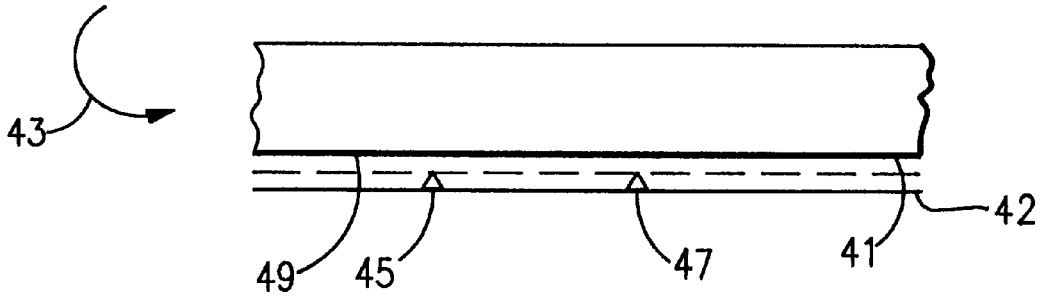
FIG. 5 represents a cross-sectional view of another embodiment of an electrolyte evacuator and an electrolyte injector according to the present invention arranged adjacent a workpiece being treated.

FIG. 5 illustrates a wafer 39 being treated. As discussed above, a boundary layer 41 may exist in the electrolyte solution surrounding the wafer 39. Typically, the boundary layer is about 200 nm to about 300 nm thick. As illustrated by arrow 43, the substrate may be rotating. The embodiment of the present invention illustrated in FIG. 5 includes a pair of blades 45 and 47. The blades extend into the boundary layer 41 to help mechanically thin the boundary layer. The blades may also inject and evacuate electrolyte from sub micron structures on the surface 49 of wafer 39. The blades 45 and 47 may be mounted on the diffuser 42 or cup edge of a plating apparatus.

The advantages of the present invention include minimizing incorporated voids into plating material, and enhanced mass transfer. Additionally, the present invention may eliminate the need to increase the thickness of the seed layer to resist pre-clean or pre-etch processes. The present invention may also help to minimize incorporated voids by helping to eliminate trapped air bubbles and problems associated with the trapped air bubbles, such as incorporation of voids into the plated material. After treating the surface of a substrate to be plated with the present invention, the apparatus of the present invention may be moved away from the area adjacent the substrate during the majority of the plating operation. Alternatively, the present invention could remain close to the substrate and operational during at least a portion or the entirety of the plating operation. By reducing dwell times the need for bubbles to escape from sub-micron structures, the present invention may help to minimize undesirable seedlayer loss.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. An apparatus for enhancing filling of structures in a substrate, comprising:

at least one electrolyte evacuator adjacent a surface of a substrate in a plating cell for evacuating electrolyte from the structures; and at least one electrolyte injector adjacent the surface of the substrate including the structures for injecting electrolyte into the structures;

wherein the at least one electrolyte evacuator and the at least one electrolyte injector are arranged below the substrate, and wherein the surface of a substrate including the structures faces the at least one electrolyte evacuator and the at least one electrolyte injector.

2. The apparatus according to claim 1, wherein the at least one electrolyte evacuator comprises a first blade and the at least one electrolyte injector comprises a second blade.

3. The apparatus according to claim 1, further comprising:

means for altering relative positions of the at least one electrolyte evacuator and the at least one electrolyte injector and the substrate at least at some point prior to or during filling of structures.

4. The apparatus according to claim 3, wherein the position altering means comprises at least one motor for rotating at least one of the at least one electrolyte evacuator, the at least one electrolyte injector, and the substrate.

5. The apparatus according to claim 3, wherein the position altering means comprises at least one motor for laterally altering the position of at least one of the at least one electrolyte evacuator, the at least one electrolyte injector, and the substrate.

6. The apparatus according to claim 3, wherein the position altering means alters the positions of the at least one electrolyte evacuator and the at least one electrolyte injector separately from each other.

7. The apparatus according to claim 6, wherein the position altering means alters the position of the at least one electrolyte evacuator at a first rate and alters the position of the at least one electrolyte injector at a second rate.

8. The apparatus according to claim 1, wherein the at least one electrolyte evacuator and the at least one electrolyte injector are arranged below the substrate, and wherein the surface of a substrate including the structures faces the at least one electrolyte evacuator and the at least one electrolyte injector.

9. The apparatus according to claim 1, further comprising:

a substrate support for engaging and supporting a substrate;

an electrolyte reservoir; and an electrolyte solution.

10. The apparatus according to claim 1, wherein the at least one electrolyte evacuator comprises at least one first blade and the at least one electrolyte injector comprises at least one second blade.

11. The apparatus according to claim 1, further comprising:

a diffuser; and a plating cup.

12. The apparatus according to claim 1, wherein the electrolyte evacuator and the electrolyte injector are arranged in close proximity to the substrate.

13. The apparatus according to claim 1, wherein the electrolyte evacuator and the electrolyte injector are for evacuating from and injecting electrolyte into sub-micron structures.

14. The apparatus according to claim 1, wherein the electrolyte evacuator and the electrolyte injector are for evacuating from and injecting electrolyte into damascene structures.

15. The apparatus according to claim 1, wherein the electrolyte evacuator and the electrolyte injector are for evacuating from and injecting electrolyte into non-damascene structures.

16. The apparatus according to claim 1, wherein the electrolyte evacuator and the electrolyte injector have an air foil shape.

17. An apparatus for enhancing filling of structures in a substrate, comprising:

at least one electrolyte evacuator adjacent a surface of a substrate in a plating cell for evacuating electrolyte from the structures, the at least one electrolyte evacuator comprising a first blade; and at least one electrolyte injector adjacent the surface of the substrate including the structures for injecting electrolyte into the structures, the at least one electrolyte injector comprising a second blade.

18. The apparatus according to claim 17, wherein the first blade and the second blade do not touch the substrate.

19. The apparatus according to claim 17, wherein the first blade and the second blade are arranged less than 200 $\mu$m from the substrate.

20. The apparatus according to claim 17, further comprising:

means for altering relative positions of the first blade and the second blade and the substrate at least at some point prior to or during filling of structures in the substrate.

21. The apparatus according to claim 20, wherein the position altering means comprises at least one motor for rotating at least one of the first blade, the second blade, and the substrate.

22. The apparatus according to claim 20, wherein the position altering means alters the positions of the first blade and the second blade separately from each other.

23. The apparatus according to claim 22, wherein the position altering means alters the position of the first blade at a first rate and alters the position of the second blade at a second rate.

24. The apparatus according to claim 20, wherein the position altering means comprises at least one motor for laterally altering the position of at least one of the first blade, the second blade, and the substrate.

25. The apparatus according to claim 17, wherein the first blade and the second blade are arranged below the substrate, and wherein the surface of a substrate including the structures faces the first blade and the second blade.

26. The apparatus according to claim 17, wherein the first blade has a first inclination and the second blade has a second inclination opposite to the first inclination.

27. The apparatus according to claim 17, wherein the electrolyte evacuator and the electrolyte injector have a planar portion facing the surface of the substrate.

28. The apparatus according to claim 27, wherein the planar surface extends along the length of the blades has a width of about 2 mm to about 4 mm.

29. An apparatus for enhancing filling of structures in a substrate, comprising:

at least one electrolyte evacuator adjacent a surface of a substrate in a plating cell for evacuating electrolyte from the structures;

at least one electrolyte injector adjacent the surface of the substrate including the structures for injecting electrolyte into the structures; and means for altering relative positions of the at least one electrolyte evacuator and the at least one electrolyte injector and the substrate at least at some point prior to or during filling of structures, wherein the position altering means comprises at least one motor for laterally altering the position of at least one of the at least one electrolyte evacuator, the at least one electrolyte injector, and the substrate.

30. An apparatus for enhancing filling of structures in a substrate, comprising:

at least one electrolyte evacuator adjacent a surface of a substrate in a plating cell for evacuating electrolyte from the structures;

at least one electrolyte injector adjacent the surface of the substrate including the structures for injecting electrolyte into the structures; and means for altering relative positions of the at least one electrolyte evacuator and the at least one electrolyte injector and the substrate at least at some point prior to or during filling of structures, wherein the position altering means alters the positions of the at least one electrolyte evacuator and the at least one electrolyte injector separately from each other.

31. An apparatus for enhancing filling of structures in a substrate, comprising:

at least one electrolyte evacuator adjacent a surface of a substrate in a plating cell for evacuating electrolyte from the structures, the at least one electrolyte evacuator comprising at least one first blade;

at least one electrolyte injector adjacent the surface of the substrate including the structures for injecting electrolyte into the structures, the at least one electrolyte injector comprising at least one second blade.

32. An apparatus for enhancing filling of structures in a substrate, comprising:

at least one electrolyte evacuator adjacent a surface of a substrate in a plating cell for evacuating electrolyte from the structures;

at least one electrolyte injector adjacent the surface of the substrate including the structures for injecting electrolyte into the structures;

a diffuser; and a plating cup.

33. An apparatus for enhancing filling of structures in a substrate, comprising:

at least one electrolyte evacuator adjacent a surface of a substrate in a plating cell for evacuating electrolyte from the structures;

at least one electrolyte injector adjacent the surface of the substrate including the structures for injecting electrolyte into the structures;

wherein the electrolyte evacuator and the electrolyte injector are for evacuating from and injection electrolyte into sub-micron structures.

34. An apparatus for enhancing filling of structures in a substrate, comprising:

at least one electrolyte evacuator adjacent a surface of a substrate in a plating cell for evacuating electrolyte from the structures;

at least one electrolyte injector adjacent the surface of the substrate including the structures for injecting electrolyte into the structures;

wherein the electrolyte evacuator and the electrolyte injector are for evacuating from and injection electrolyte into damascene structures.

35. An apparatus for enhancing filling of structures in a substrate, comprising:

at least one electrolyte evacuator adjacent a surface of a substrate in a plating cell for evacuating electrolyte from the structures, wherein the at least one electrolyte evacuator has an air foil shape;

at least one electrolyte injector adjacent the surface of the substrate including the structures for injecting electrolyte into the structures, wherein the at least one electrolyte injector has an air foil shape.

* * * * *